US011781840B2

(12) United States Patent
Chase et al.

(10) Patent No.: US 11,781,840 B2
(45) Date of Patent: Oct. 10, 2023

(54) MODULAR TARGET STRUCTURE

(71) Applicant: ORIGIN Tactical Solutions LLC, Windsor, CO (US)

(72) Inventors: Matthew J. Chase, Windsor, CO (US); Darren Dugan, Windsor, CO (US)

(73) Assignee: ORIGIN Tactical Solutions LLC, Windsor, CO (US)

( * ) Notice: Subject to any disclaimer, the term of this patent is extended or adjusted under 35 U.S.C. 154(b) by 51 days.

(21) Appl. No.: 17/304,490

(22) Filed: Jun. 22, 2021

(65) Prior Publication Data

US 2021/0404776 A1 Dec. 30, 2021

Related U.S. Application Data

(60) Provisional application No. 62/705,427, filed on Jun. 26, 2020.

(51) Int. Cl.
*F41J 1/10* (2006.01)
*F41J 7/04* (2006.01)

(52) U.S. Cl.
CPC .. *F41J 7/04* (2013.01); *F41J 1/10* (2013.01)

(58) Field of Classification Search
CPC ..... F41J 1/00; F41J 1/10; F41J 7/04; B25H 1/06; E04G 1/32
USPC ..... D22/113
See application file for complete search history.

(56) References Cited

U.S. PATENT DOCUMENTS

| | | | | |
|---|---|---|---|---|
| 1,612,941 | A * | 1/1927 | Peachee | E04G 1/32 182/186.3 |
| 4,298,096 | A * | 11/1981 | Prior | B25H 1/06 182/20 |
| 4,433,843 | A * | 2/1984 | Bricco | F41J 1/10 273/408 |
| 4,638,885 | A * | 1/1987 | Frederick | B25H 1/06 269/902 |
| 9,658,035 | B2 * | 5/2017 | Pixton | F41J 1/10 |
| 10,088,279 | B2 * | 10/2018 | Hoy, Jr. | F41J 5/18 |
| 10,955,225 | B2 * | 3/2021 | Dunstan | F41J 7/04 |
| 11,162,765 | B2 * | 11/2021 | Tennison | F41J 1/10 |
| 2014/0252719 | A1 * | 9/2014 | Johnson | F41J 1/10 273/407 |
| 2018/0087881 | A1 * | 3/2018 | Bickel | F41J 1/10 |

(Continued)

OTHER PUBLICATIONS

Big Dog Steel Hostage Target, http://www.bigdogsteel.com/hostagetarget.html, archived by the Internet Archive on Jan. 28, 2020 (Year: 2020).*

*Primary Examiner* — Laura Davison
(74) *Attorney, Agent, or Firm* — Trenner Law Firm, LLC; Mark D. Trenner

(57) ABSTRACT

A modular target structure is disclosed for supporting targets during target practice. An example modular target structure includes a first leg structure, a second leg structure, and an interconnecting member. The interconnecting member connects between the first leg structure and the second leg structure to form a substantially triangular shaped support structure which can be utilized in a horizontal or vertical configuration. At least one target mount may be provided for attaching targets. The support structure is readily assembled and unassembled and can be configured between an operating position for target practice, and a collapsed position for transport and storage.

18 Claims, 22 Drawing Sheets

(56) References Cited

U.S. PATENT DOCUMENTS

| | | | | |
|---|---|---|---|---|
| 2019/0011229 | A1* | 1/2019 | Babcock | F41J 1/10 |
| 2019/0219370 | A1* | 7/2019 | Anderson | F41J 1/10 |

* cited by examiner

MODULAR TARGET STRUCTURE

CROSS REFERENCE TO RELATED APPLICATION

This application claims the priority filing benefit of U.S. Provisional Patent Application No. 62/705,427 filed on Jun. 26, 2020 titled "modular target structure With Targets" of Matthew J. Chase and Darren Dugan, hereby incorporated by reference in its entirety as though fully set forth herein.

BACKGROUND

Target practice is an important aspect of firearm training for law enforcement and other individuals. At indoor target ranges, paper targets are typically hung by a hanger on a wire that can be moved out any desired distance from the shooter. Unfortunately, indoor target ranges can be expensive, crowded, noisy, and are not available in all areas.

Often, those desiring target practice head outdoors. Target shooting is permitted on a lot of federal land and on private property. In addition to overcoming the shortfalls of indoor target ranges, outdoor ranges allow shooters to be outdoors, often with more space around them, at little or no cost. The primary drawback is having to bring along their own target.

At outdoor target ranges, targets are often tacked to cardboard boxes, fallen trees, strung between trees or other objects in the field, etc. These targets are often unstable and may fall over during target practice and need to be set up again several times during the course of target practice. Professional targets are available, but are often bulky to withstand being shot at without falling over, and can be heavy or cumbersome to carry out in the field and set up for use.

In addition, not all targets are suitable for all types of shooting. For example, long range rifle shooting may require a different target than targets used for up-close handgun training. This either limits the shooter to a single type of target practice, or requires multiple different types of targets be taken into the field.

DETAILED DESCRIPTION

An example modular target structure is disclosed as it may be implemented for holding targets during target practice. The example modular target structure is compact in it's unassembled configuration, making it easy to carry and store or transport. The example modular target structure is readily assembled for use in a variety of different operational configurations with a variety of different types of targets.

The example modular target structure has a compact base that is stable and can be configured in a way that can be implemented for use with horizontal shooting targets and vertical shooting targets. The example modular target structure may include interchangeable adapters that enable a user to change various types and sizes of targets quickly and easily in the field.

The example modular target structure solves the issues that bulky, heavy, steel, target stands currently in the market. The design allows for an easy setup and takedown, and is compact and lightweight so that it can be carried by most users in one hand to any desired location for setup and use. The modular target structure can be quickly assembled and secured to make for more time shooting targets and less time and hassle to assemble and fix the targets during shooting.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

Figure 1A:
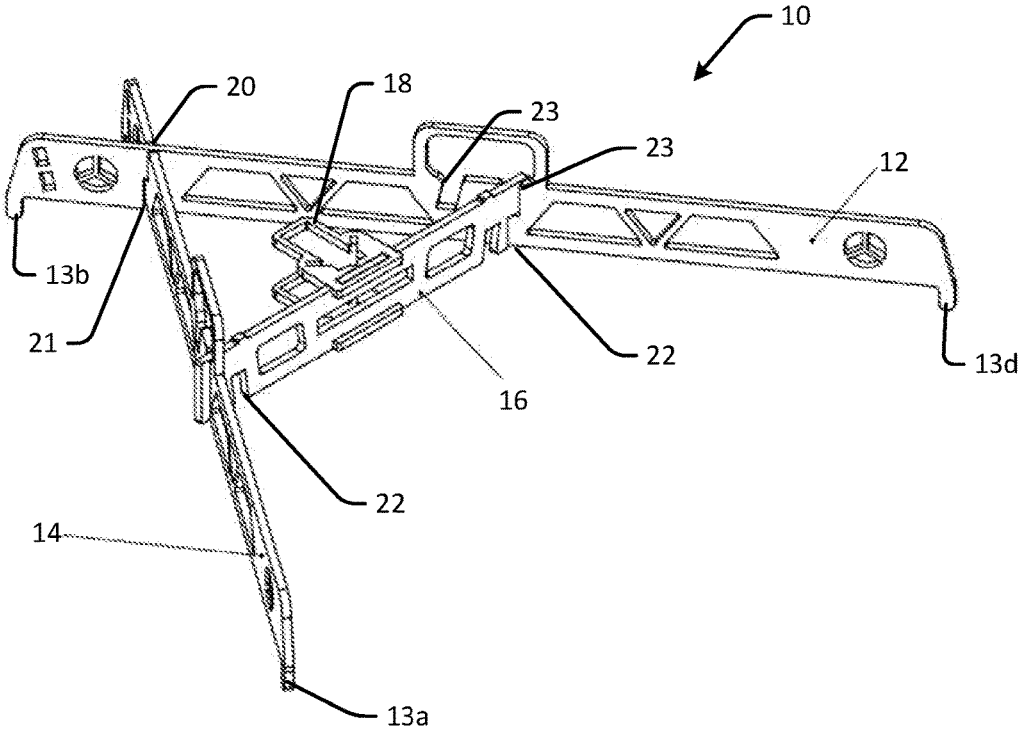
FIG. 1A is a top perspective view of an example modular target structure.
Figure 1B:
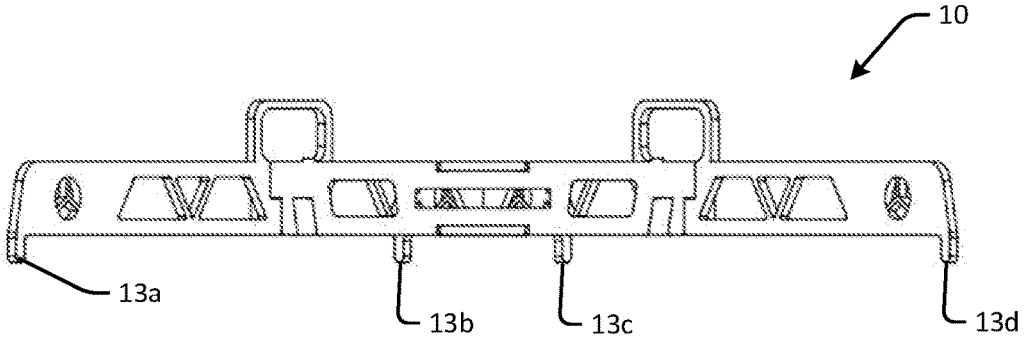
FIG. 1B is a side view of the example modular target structure corresponding to FIG. 1A.
Figure 2A:
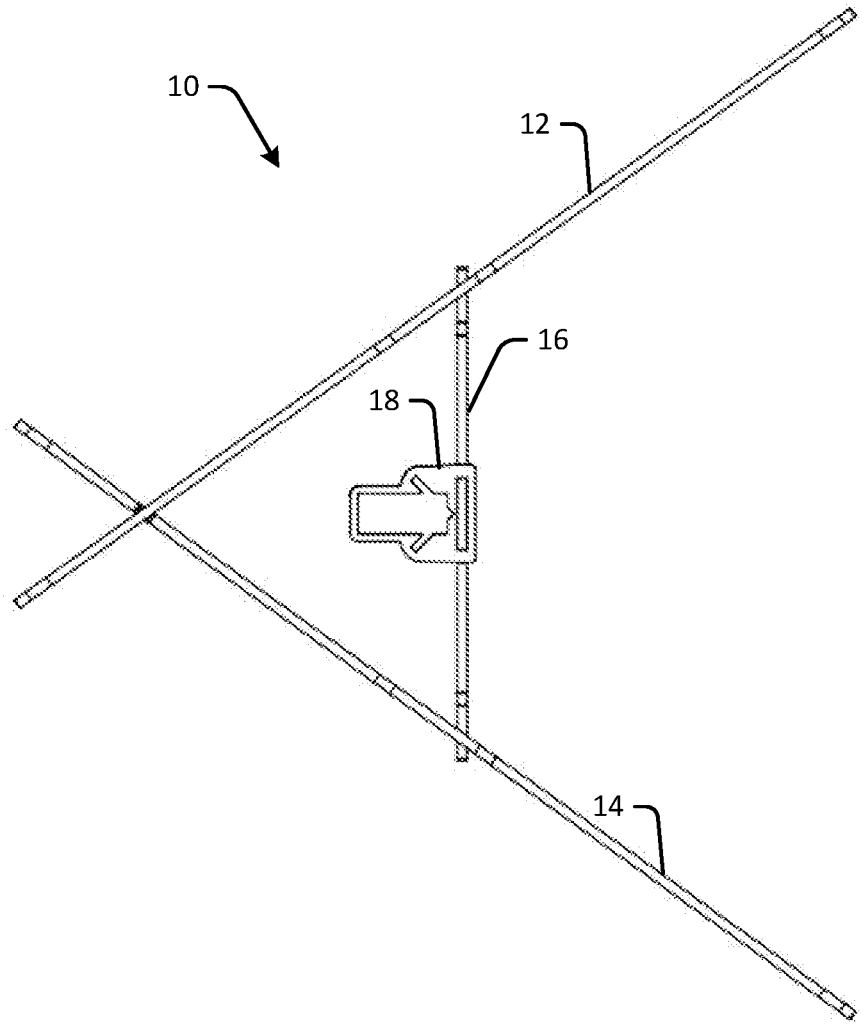
FIG. 2A is a top view of an example modular target structure.
Figure 2B:
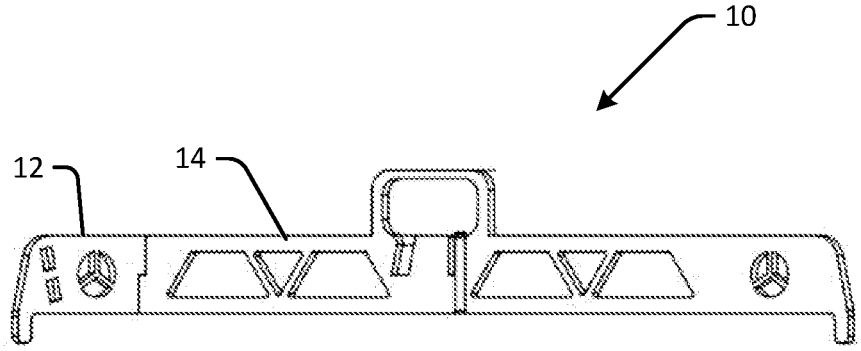
FIG. 2B is a side view of the example modular target structure corresponding to FIG. 2A.
Figure 3A:
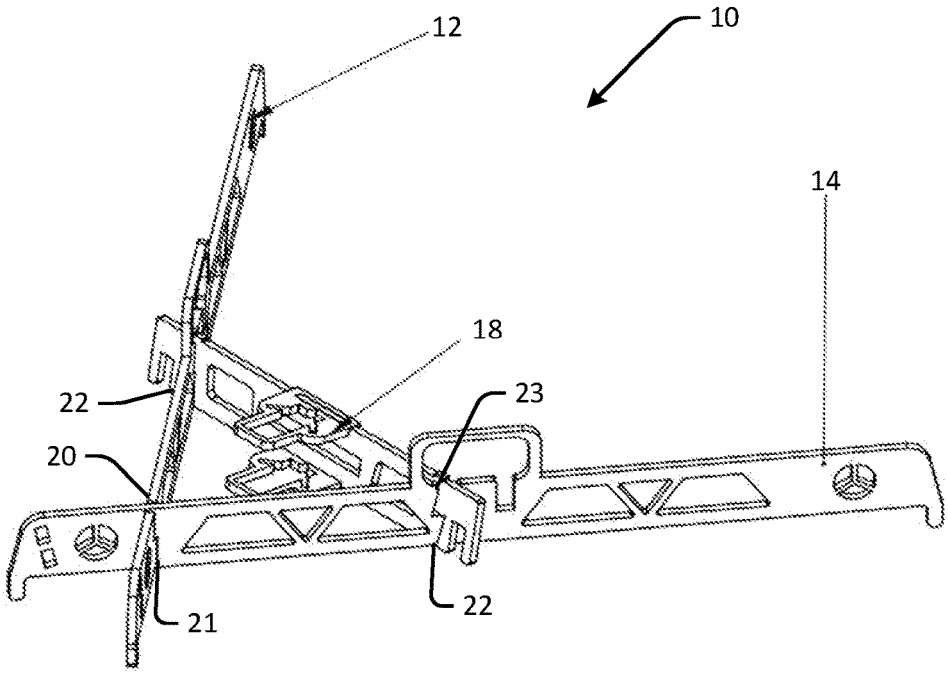
FIG. 3A is another top perspective view of an example modular target structure.
Figure 3B:
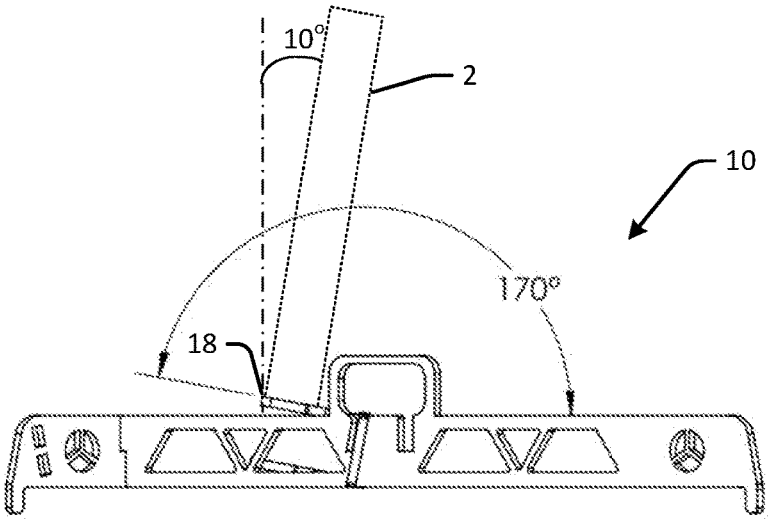
FIG. 3B is a side view of the example modular target structure corresponding to FIG. 3A.
Figure 4A:
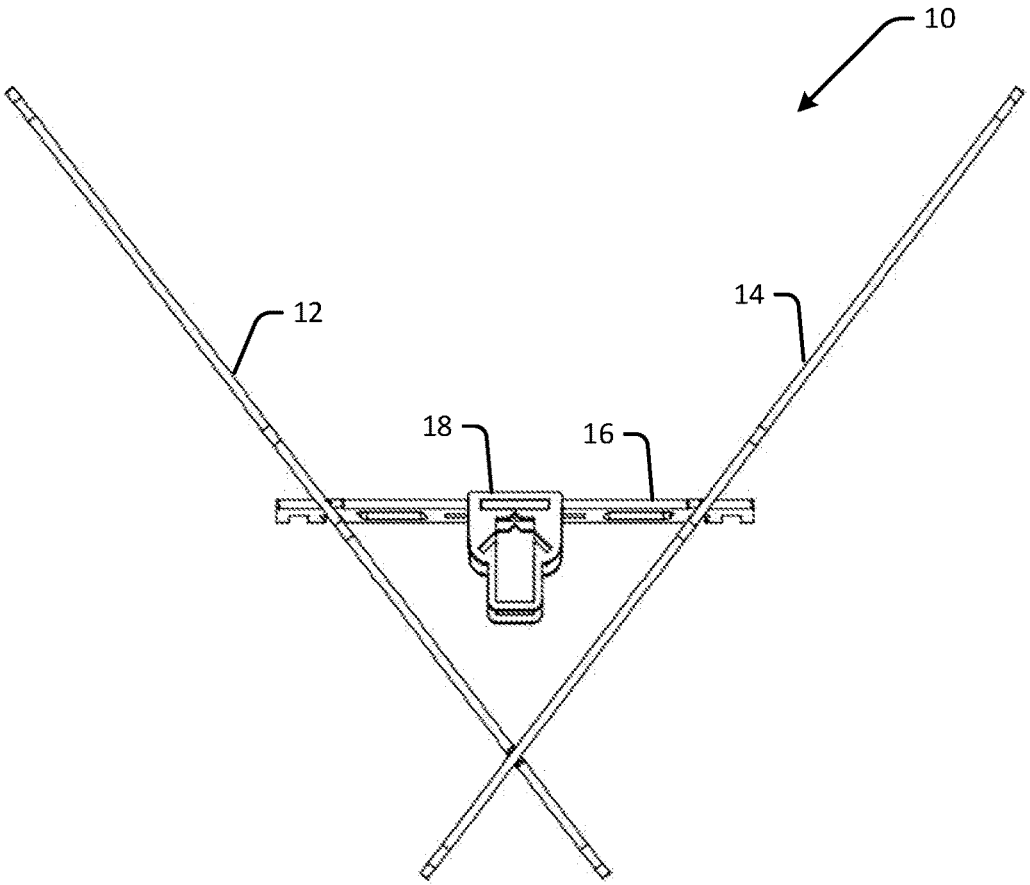
FIG. 4A is a top view of an example modular target structure.
Figure 4B:
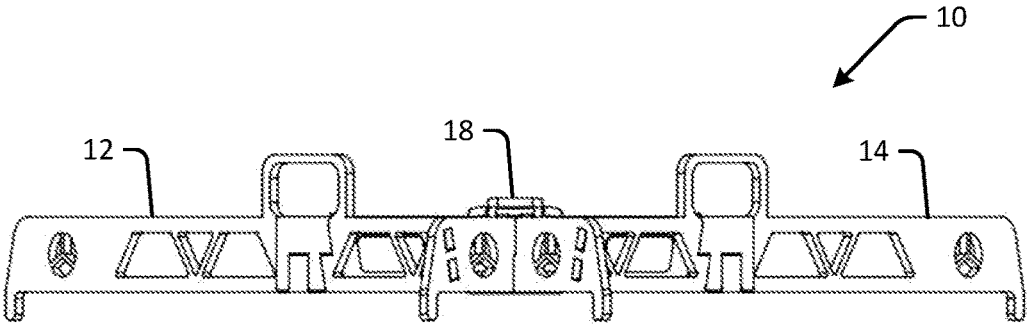
FIG. 4B is a side view of the example modular target structure corresponding to FIG. 4A.

FIG. 1A is a top perspective view of an example modular target structure 10. FIG. 1B is a side view of the example modular target structure 10 corresponding to FIG. 1A. FIG. 2A is a top view of an example modular target structure 10. FIG. 2B is a side view of the example modular target structure 10 corresponding to FIG. 2A. FIG. 3A is another top perspective view of an example modular target structure 10. FIG. 3B is a side view of the example modular target structure 10 corresponding to FIG. 3A. FIG. 4A is a top view of an example modular target structure 10. FIG. 4B is a side view of the example modular target structure 10 corresponding to FIG. 4A.

The example modular target structure 10 may be implemented for supporting targets during target practice. An example of the modular target structure 10 includes a first leg structure 12 and a second leg structure 14. An interconnecting member 16 is provided for connecting between the first leg structure 12 and the second leg structure 14 to form a substantially triangular shaped support structure. It is noted that in other examples, the support structure may be configured in different shapes (e.g., square or rectangular).

In an example, the first leg structure 12 and a second leg structure 14 each have legs 13*a-d*. The legs 13*a-d* are formed on each end of the leg structures 12 and 14 and raise the support structure above the ground when the support structure is in a horizontal position on the ground. In another example, the legs may be height adjustable and/or more or fewer legs may be provided.

In an example, the support structure is assembled via interlocking slots. The slots can be seen, for example in FIG. 3A, and are more clearly visible in the exploded or unassembled view in FIG. 5A. In an example, a first interlocking slot 20 is formed on an upper portion of a first end of the first leg structure 12. A corresponding second interlocking slot 21 is formed on a lower portion of a first end of the second leg structure 14. The first interlocking slot 20 fits into the second interlocking slot 21 to removably secure the first leg structure 12 to the second leg structure 14 in an operating position, e.g., to form the support structure shown in FIG. 1A.

Interlocking slots are also provided for connecting the interconnecting member 16 on each end to the respective leg structures 12 and 14. The slots 22 are visible in FIGS. 1A and 3A, but are more clearly visible in FIGS. 5A-5B and 6A-6B) fit into corresponding slots 23 in the leg structures 12 and 14.

In an example, multiple different slots are provided to enable the interconnecting member 16 to be positioned at different locations along the length of the leg structure 12 and 14. Selecting from among the different slots enables the end-user to configure a stance between the leg structures 12 and 14 (e.g., a wider or narrower stance). The stance may be selected by the end-user based on various considerations, such as the desired or needed stability of the base for the type of target and/or shooting, the terrain, etc.

In an example, the slots 23 may also be angled so that a post 2 in the post support 18 is offset, as illustrated in FIG. 3B. In this example, the offset is about 10 degrees relative to perpendicular or a vertically upright post (e.g., 170 degrees relative to a horizontal plane). It is noted that other offsets may also be implemented, depending on design considerations such as, but not limited to the desired target angle and/or stability of the target.

Figure 5A:
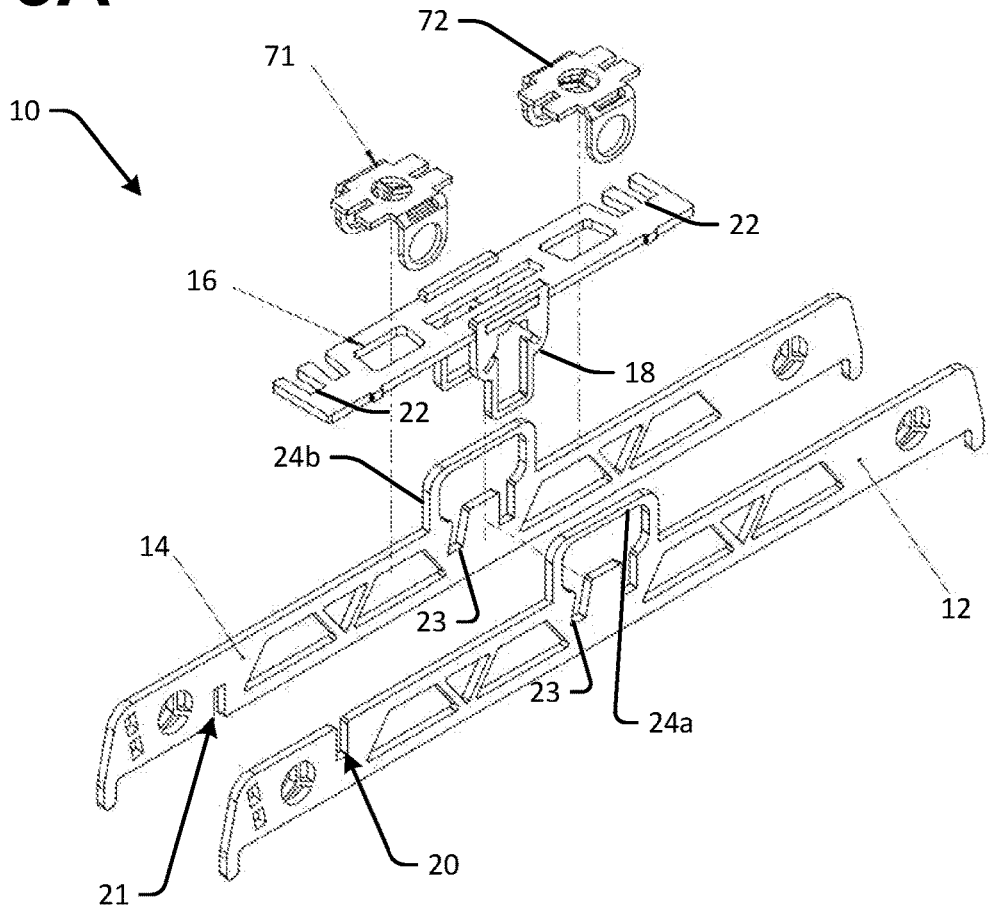
FIG. 5A is a perspective view of the example modular target structure shown in an unassembled configuration.
Figure 5B:
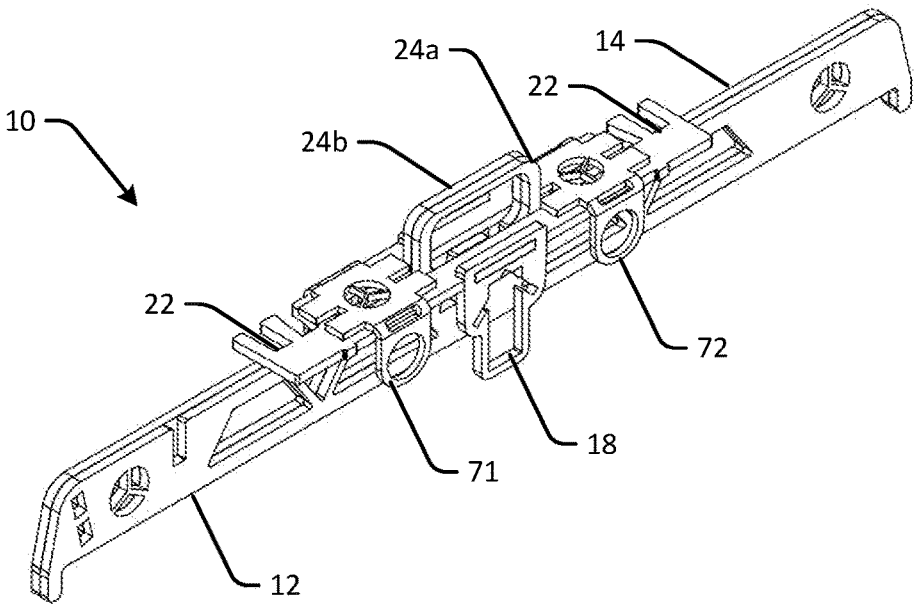
FIG. 5B is a perspective view of the example modular target structure corresponding to FIG. 5A and shown in a closed configuration for transport and storage.

FIG. 5A is a perspective view of the example modular target structure 10 shown in an unassembled configuration. FIG. 5B is a perspective view of the example modular target structure 10 corresponding to FIG. 5A and shown in a closed configuration for transport and storage. In an example, the support structure is configurable between at least one operating position for target practice, and a collapsed position for transport and storage. In an example, the first leg structure 12 and the second leg structure 14 each have an integrally formed handles 24*a*, 24*b* to make it easier to carry the modular target structure 10.

Once assembled (e.g., as shown in FIGS. 1A and 3A), the support structure provides a solid base that can be configured in any of a variety of different manners for multiple different types and sizes of targets. To accomplish this aspect, the example modular target structure 10 has at least one target mount. Multiple different types of target mounts may be provided to enable the same support structure to be utilized with different types and sizes of targets.

Figure 6A:
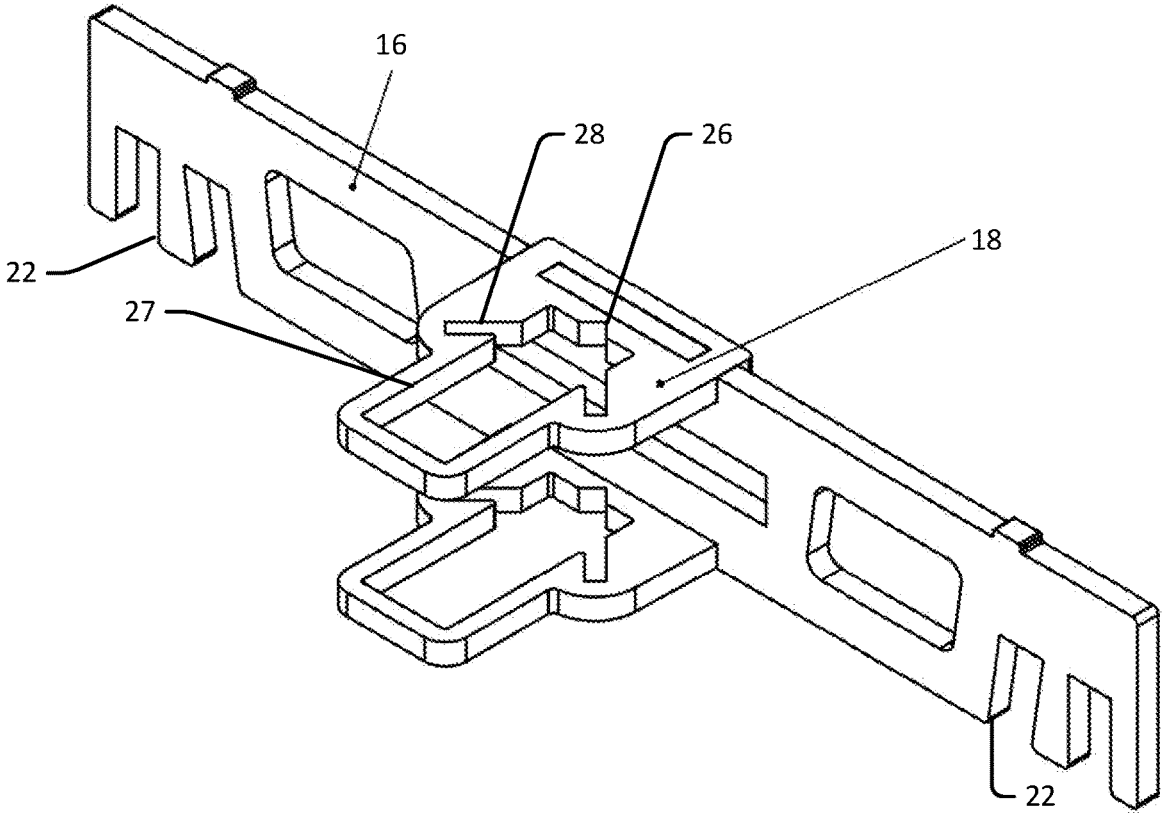
FIG. 6A is a perspective view of an example cross member configured with a post support.
Figure 6B:
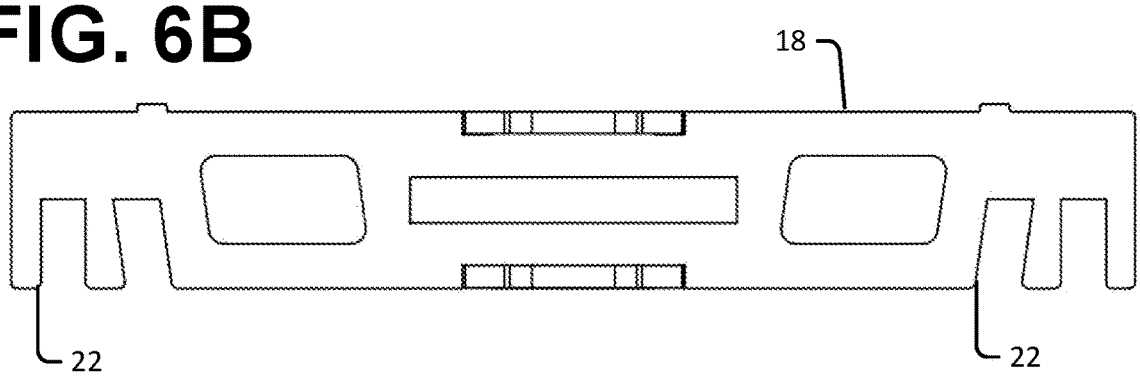
FIG. 6B is a side view of the example cross member corresponding to FIG. 6A.

An example of one type of target mount for the modular target structure 10 is provided as a post support 18 on the interconnecting member 16. FIG. 6A is a perspective view of an example cross member 16 configured with a post support 18. FIG. 6B is a side view of the example cross member 16 corresponding to FIG. 6A. A post (e.g., metal rectangular tube, 2×4 or other wood post) may be provided into the post support 18 and targets can be provided with and/or attached to the post. Various examples of targets which may be mounted via the post support 18 are shown in the figures for purposes of illustration. However, the modular target structure 10 is not limited to use with any particular type of target.

Figure 7:
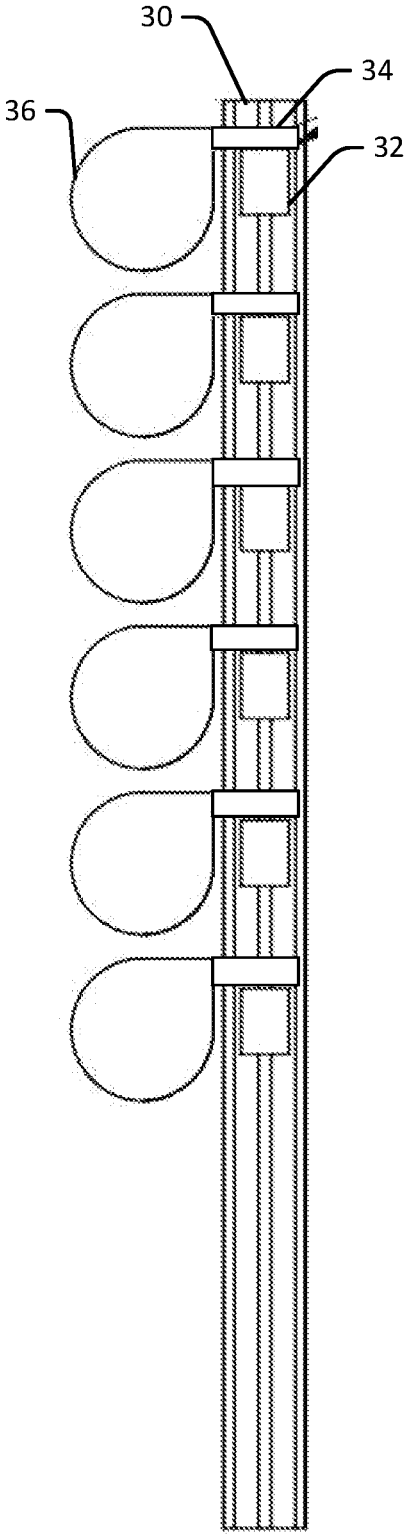
FIGS. 7-8 show an example target post for the modular target structure configured for flag and/or hook targets.

In an example, the post support 18 has a dual configuration. That is, the post support 18 is configured with an opening 26 having a rectangular shaped perimeter 27 for holding a rectangular shape post (e.g., a 2×4 piece of wood for stapling paper targets). The post support 18 also has a 90 degree angle bracket or substantially L-shaped opening 28 for holding a 90 degree or substantially L-shaped metal post (e.g., for steel targets). An example angle bracket post 30 is shown in FIG. 7 as it may be configured for holding flag targets. It is noted that the post support 18 may be provided in any of a variety of different sizes and/or shapes to accommodate other post types and sizes, including but not limited to circular, triangular, and other shapes.

The post may support any of a variety of different types of targets (e.g., hooks, flags, paddles), number of targets, and size of targets. Examples of different targets are discussed below for purposes of illustration. It is noted, however, that the modular target structure 10 is not limited to any particular type of target.

Figure 8:
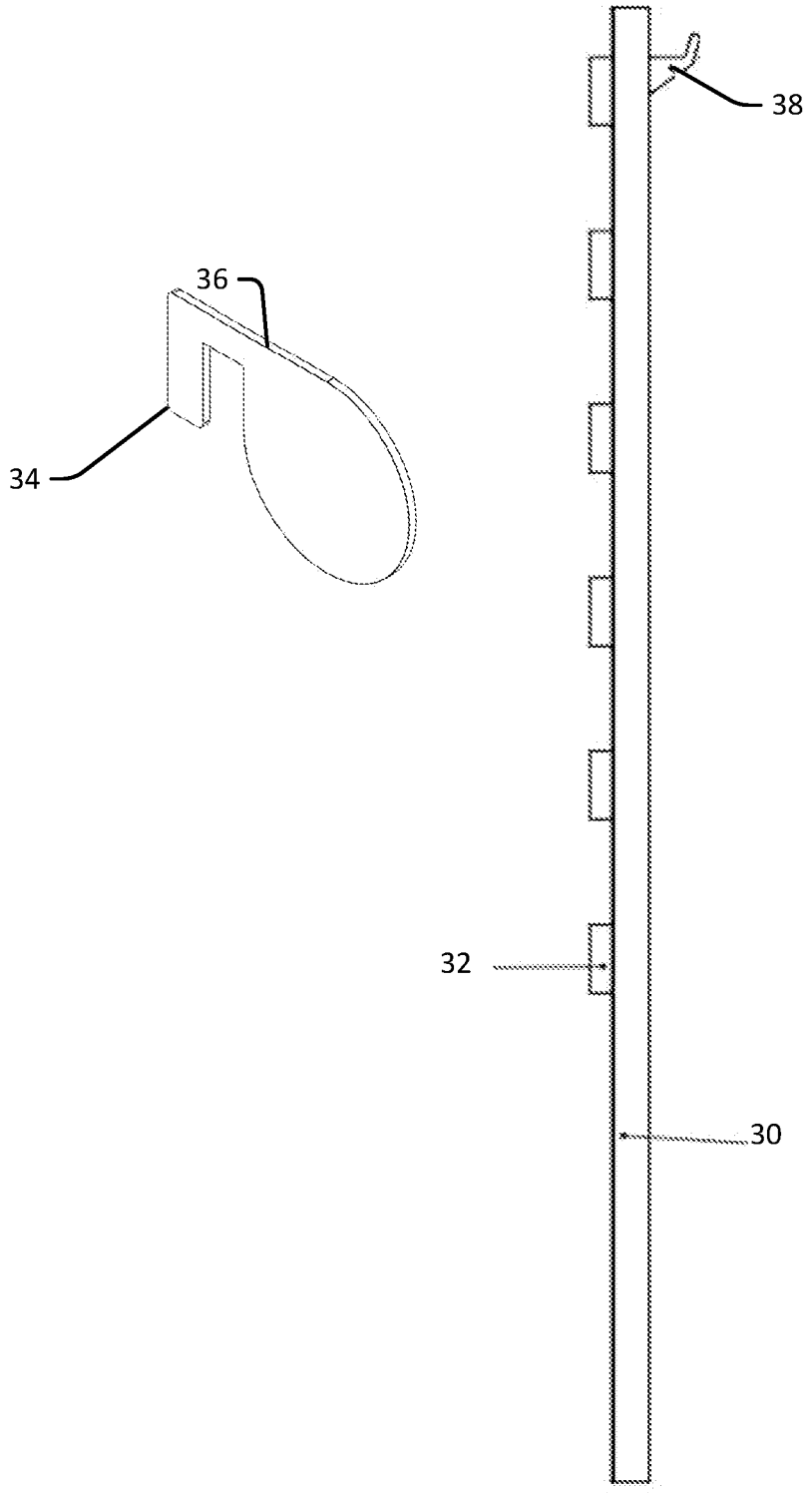

FIGS. 7-8 show an example target post 30 for the modular target structure 10 configured for flag and/or hook targets. The target post 30 may be inserted into the post holder 18 (e.g., angle bracket opening 28) to hold the target post 30 substantially upright (e.g., offset by about 10 degrees as explained above) in the support structure of the modular target structure 10.

In an example, the target post 30 has one or more socket 32 to receive a mounting portion 34 of a flag target 36. This enables the flag target 36 to be rotated into a firing position. The flag target 36 then rotates on the post when the target flag is hit by a firing round, thereby indicating a successful shot.

In an example, the target post 30 also has a hook 38. The hook 38 may be provided for hanging a target on the post 30.

Figure 9:
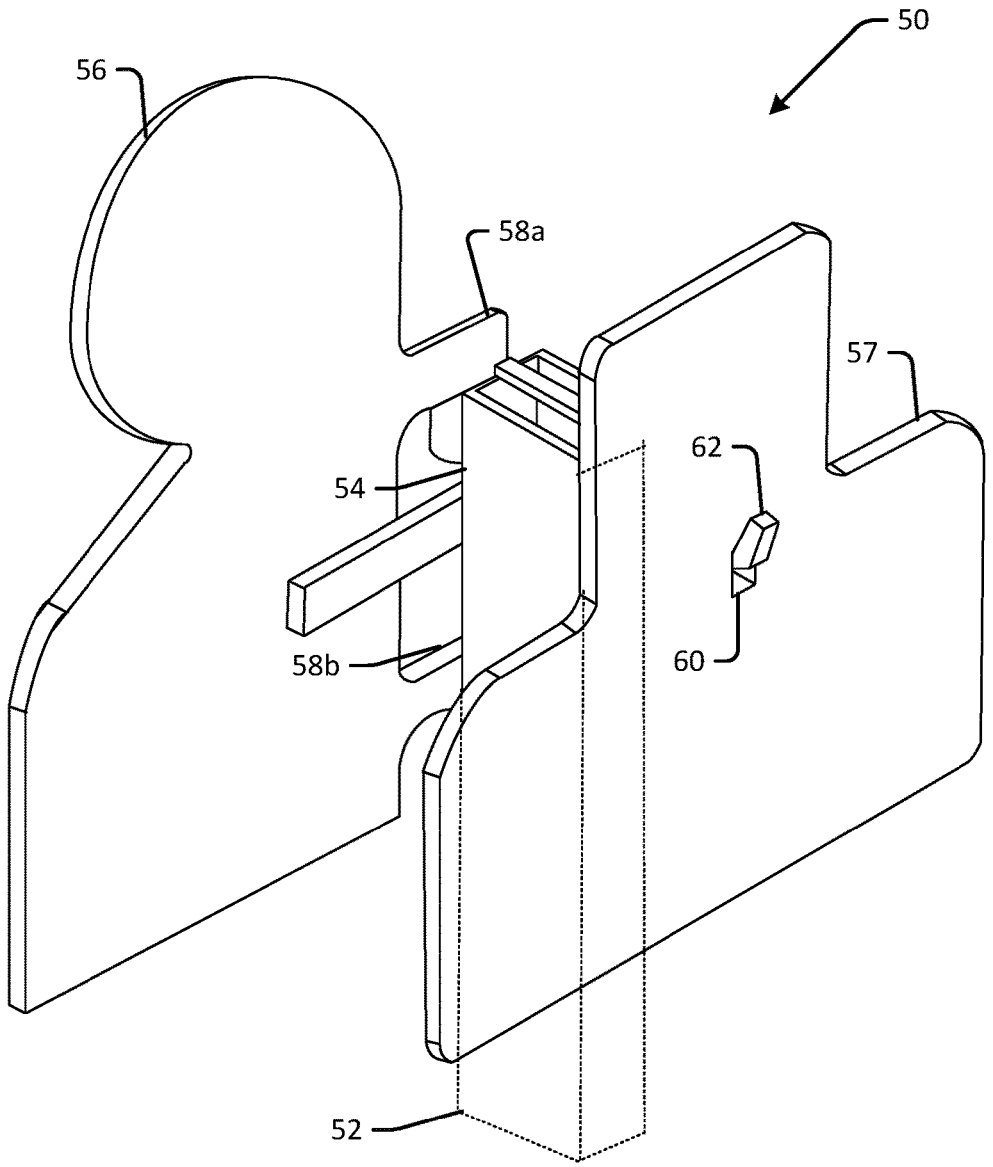
FIG. 9 is a perspective view of an example silhouette target for the modular target structure.

FIG. 9 is a perspective view of an example silhouette target 50 for the modular target structure 10. The silhouette target 50 may be provided on a post 52 and inserted into the post holder 18. In this example, the post 52 is rectangular to be inserted into opening 30 of the post holder 18. However, the post for silhouette target 50 may be any suitable shape.

Figure 10A:
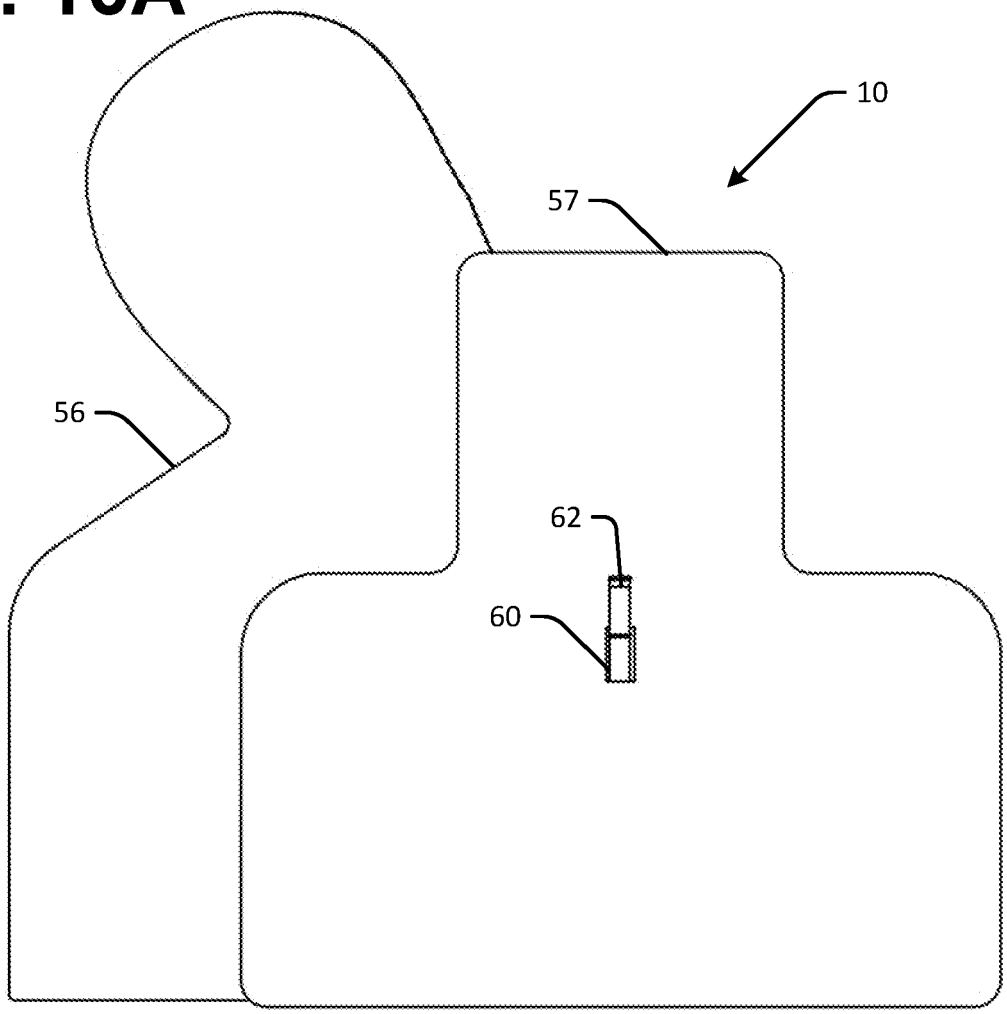
FIG. 10A is a front view of the example silhouette target corresponding to FIG. 9.
Figure 10B:
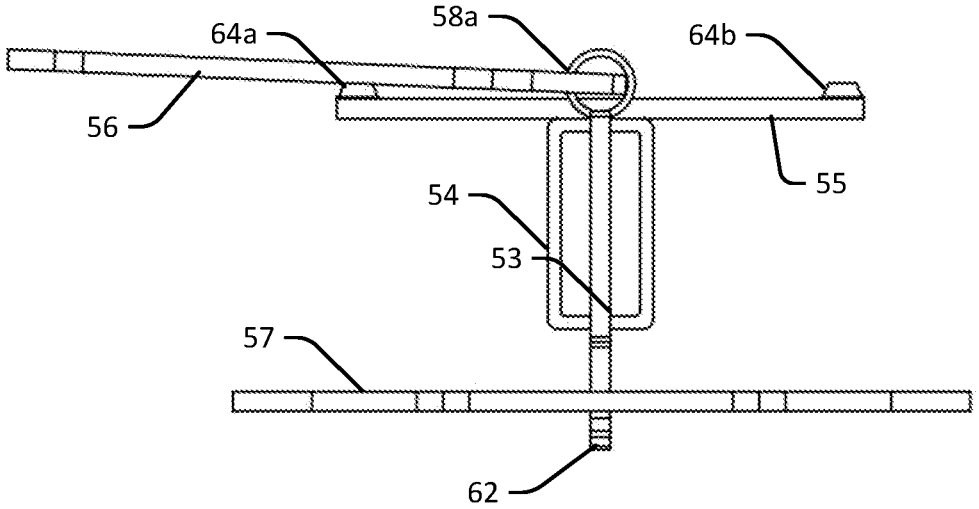
FIG. 10B is a top view of the example silhouette target corresponding to FIG. 9.
Figure 11:
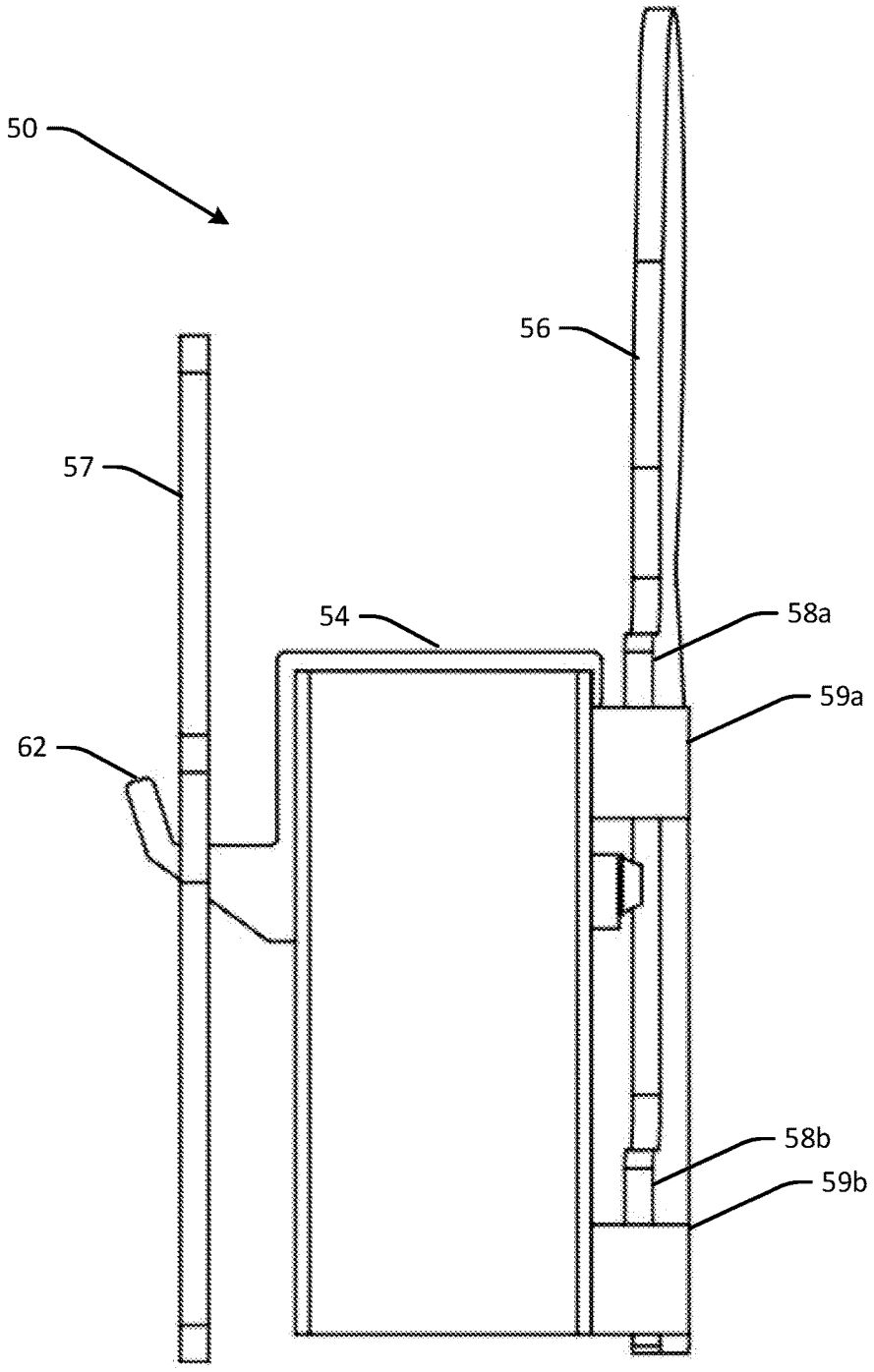
FIG. 11 is a side view of the example silhouette target corresponding to FIG. 9.
Figure 12:
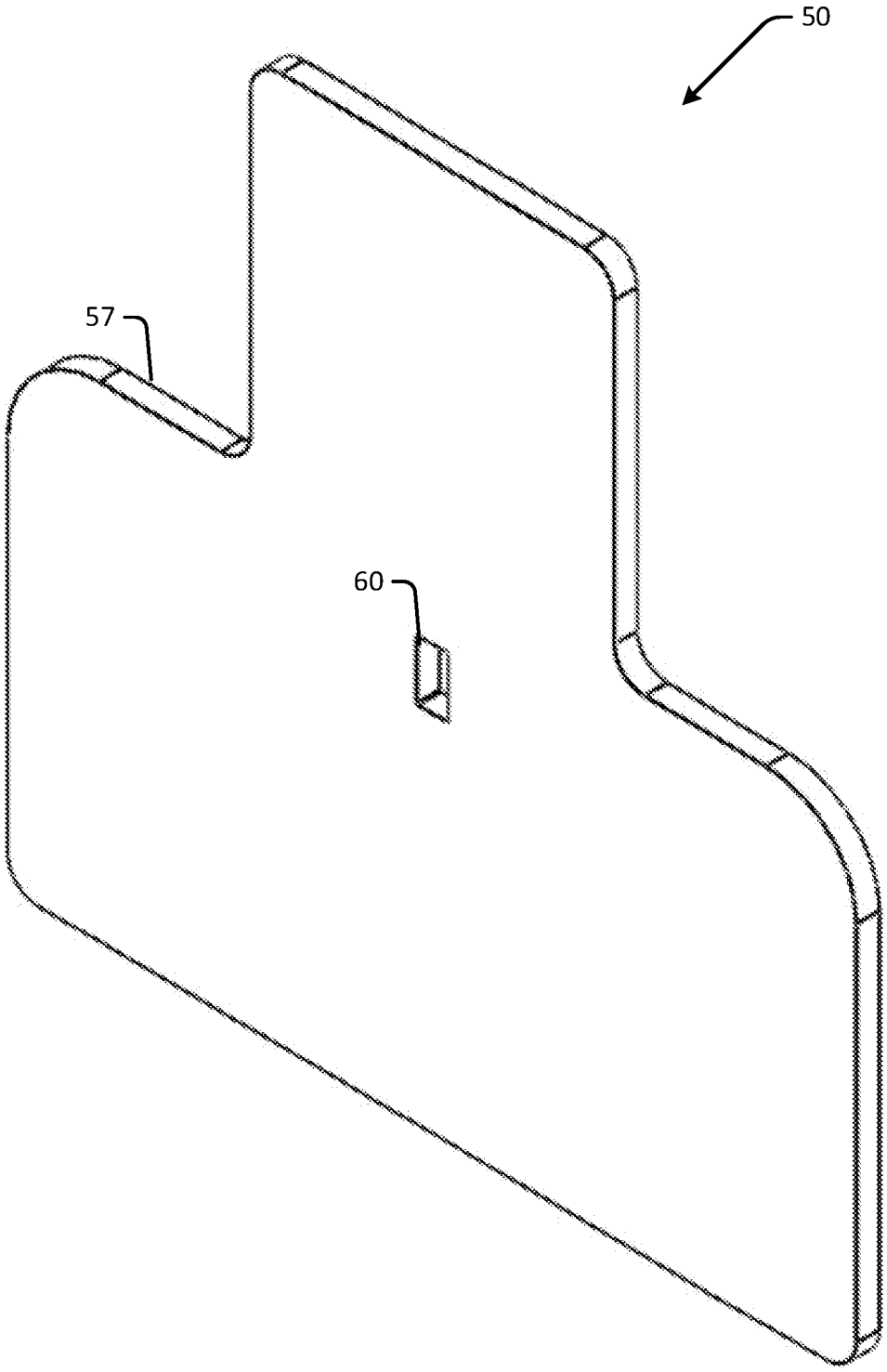
FIG. 12 is a perspective view of a hostage target of the example silhouette target corresponding to FIG. 9.
Figure 13:
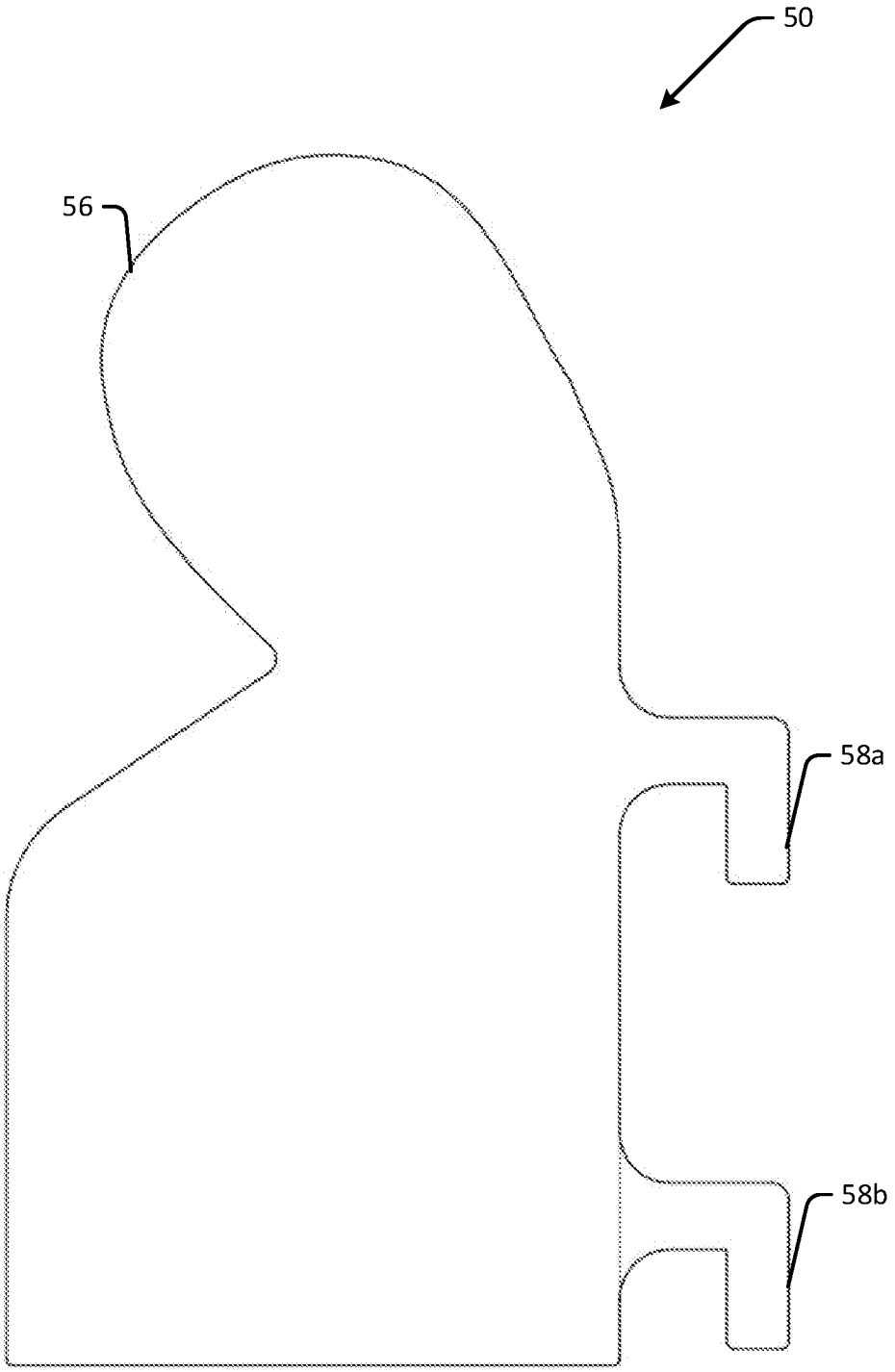
FIG. 13 is a side view of a hostage-taker target of the example silhouette target corresponding to FIG. 9.
Figure 14:
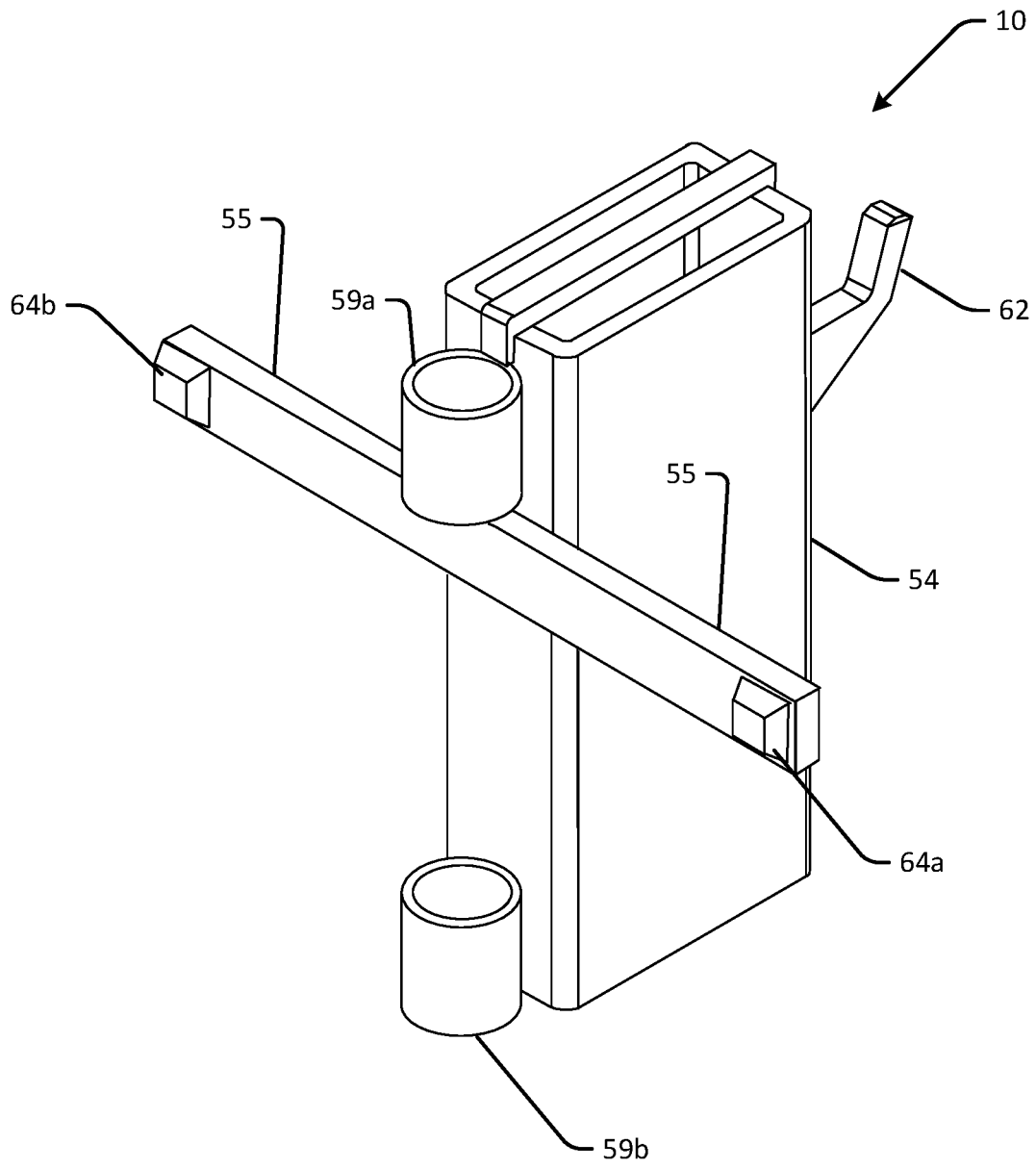
FIG. 14 is a perspective view of a support structure for the silhouette target corresponding to FIG. 9.

FIG. 10A is a front view of the example silhouette target 50 corresponding to FIG. 9. FIG. 10B is a top view of the example silhouette target 50 corresponding to FIG. 9. FIG. 11 is a side view of the example silhouette target 50 corresponding to FIG. 9. FIG. 12 is a perspective view of a hostage target of the example silhouette target 50 corresponding to FIG. 9. FIG. 13 is a side view of a hostage-taker target of the example silhouette target 50 corresponding to FIG. 9. FIG. 14 is a perspective view of a support structure for the silhouette target 50 corresponding to FIG. 9.

The silhouette target 50 may be mounted to the post 52 by an adapter 54 (FIG. 14). The silhouette target adapter supports the silhouette target 50. The example adapter 54 includes a post mount 53, a hook 62, and a backboard 55. The backboard 55 may include padded tabs 64*a-b*.

In the example shown, the silhouette target 50 includes a hostage-taker target 56 and a hostage target 57. The hostage-taker target 56 is mounted by hinge points (tabs 58*a*, 58*b* in cylinders 59*a*, 59*b*) to the adapter 54. This enables the hostage-taker target 56 to rotate independently of the hostage target on the post 52 when the hostage-taker target is hit by a firing round. The hostage target 57 is provided through opening 60 and hung on the hook 62 on the adapter 54. In an example, the hostage target 57 falls from the hook when the hostage target is hit by a firing round.

Figure 15:
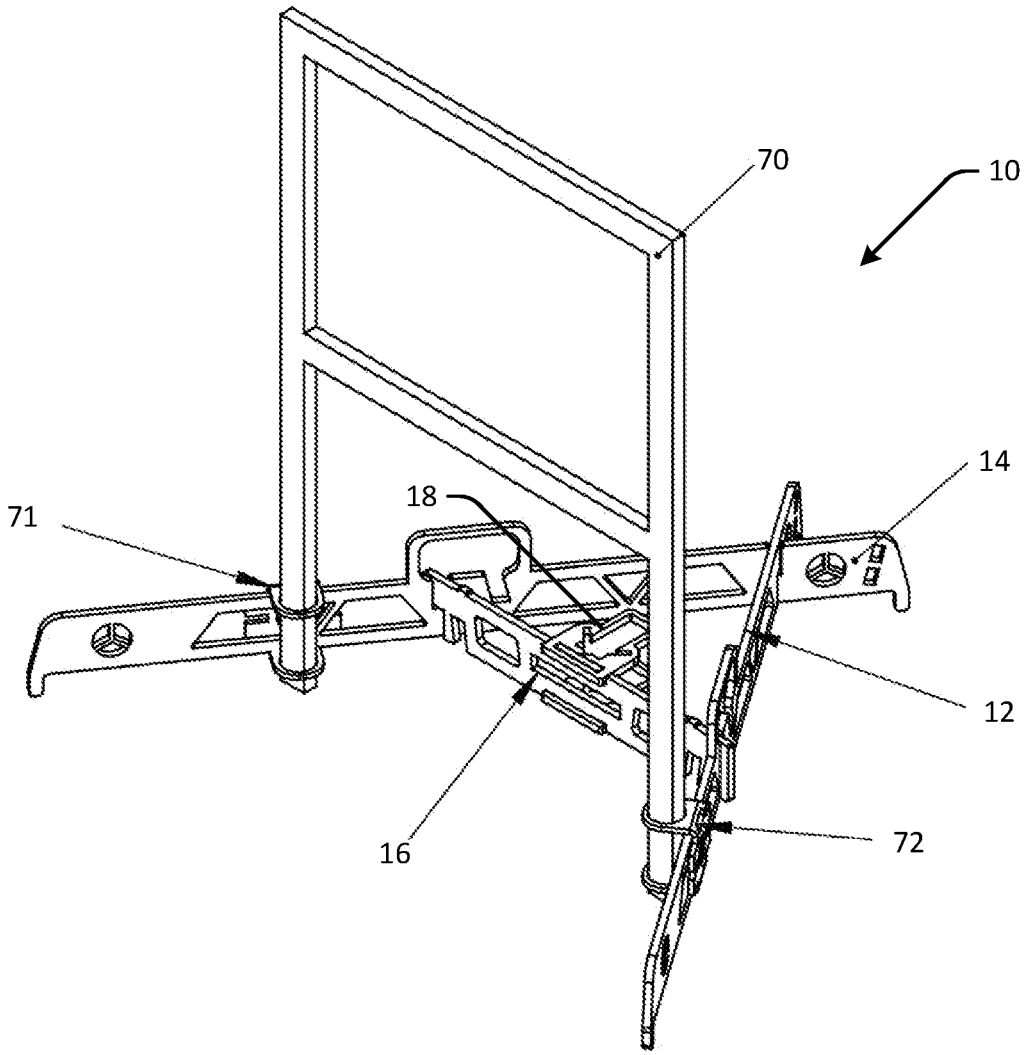
FIG. 15 is a perspective view of the example modular target structure configured with an example target frame.
Figure 16:
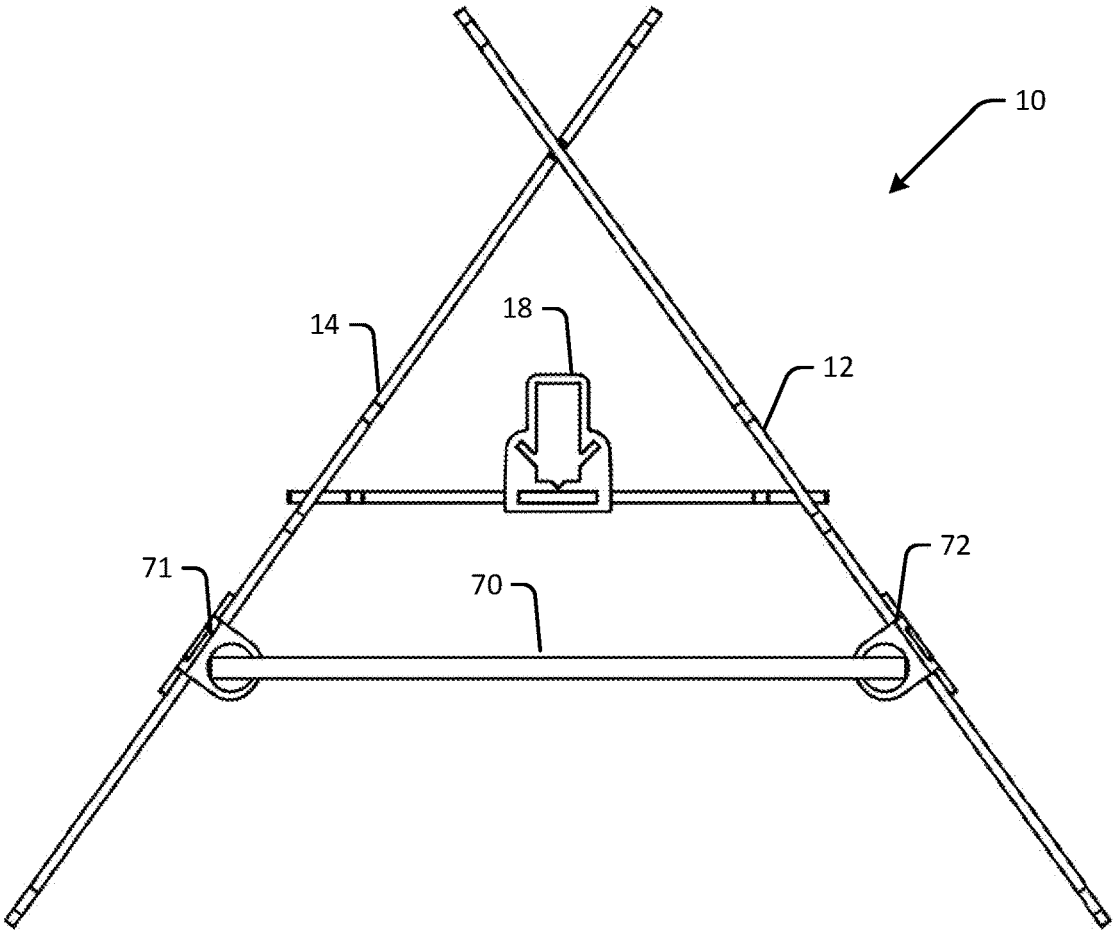
FIG. 16 is a top view of the example modular target structure corresponding to FIG. 15.
Figure 17A:
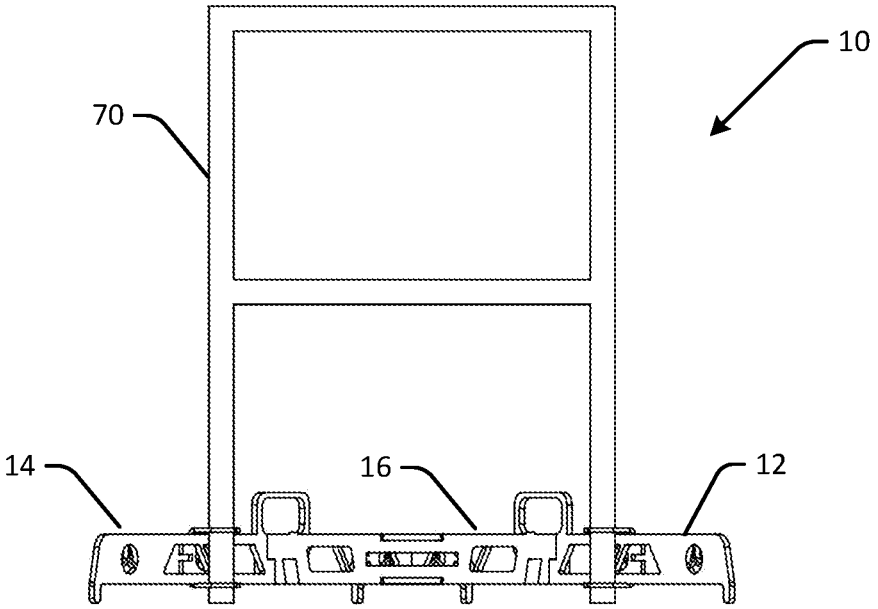
FIG. 17A is a front view of the example modular target structure corresponding to FIG. 15.
Figure 17B:
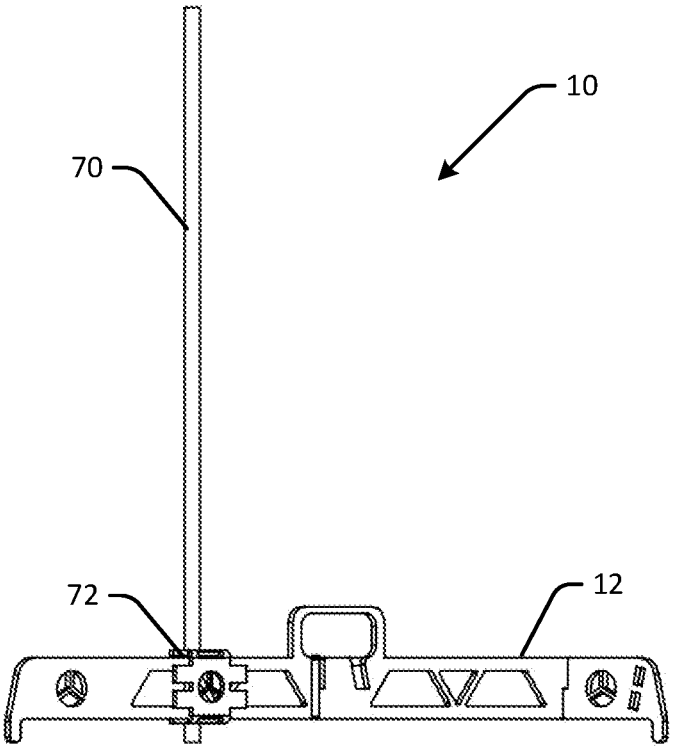
FIG. 17B is a side view of the example modular target structure corresponding to FIG. 15.

An example of another target support structure is described in FIGS. 15 through 17A and 17B. FIG. 15 is a perspective view of the example modular target structure 10 configured with an example target frame 70. FIG. 16 is a top view of the example modular target structure 10 corresponding to FIG. 15. FIG. 17A is a front view of the example modular target structure 10 corresponding to FIG. 15. FIG. 17B is a side view of the example modular target structure 10 corresponding to FIG. 15.

In an example, a first target frame mount 71 is provided on the first leg structure 12. A second target frame mount 72 is provided on the second leg structure 14. The target frame mounts 71, 72 may be similar in configuration to the post support 18, thereby increasing modularity of the modular target structure 10. The legs of the target frame 70 connect into the first target frame mount 71 and the second target frame mount 72.

Figure 18A:
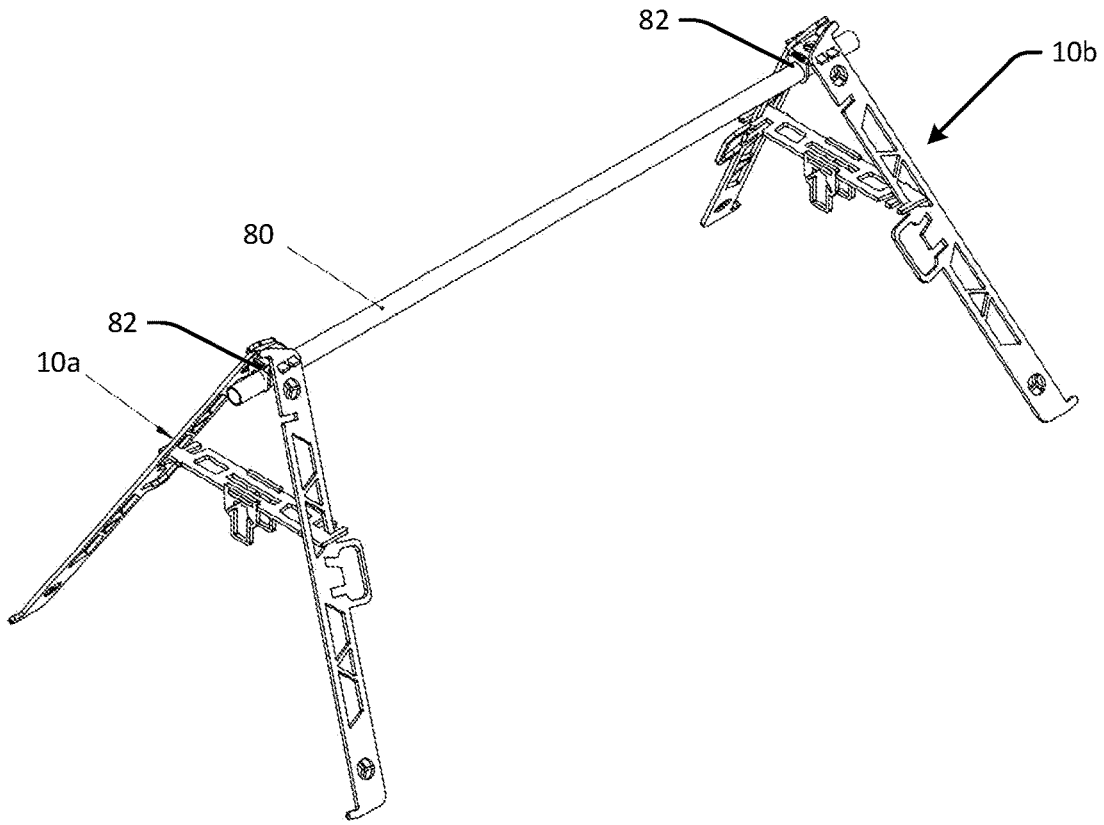
FIG. 18A is a perspective view of two modular target structures configured to support a beam.
Figure 18B:
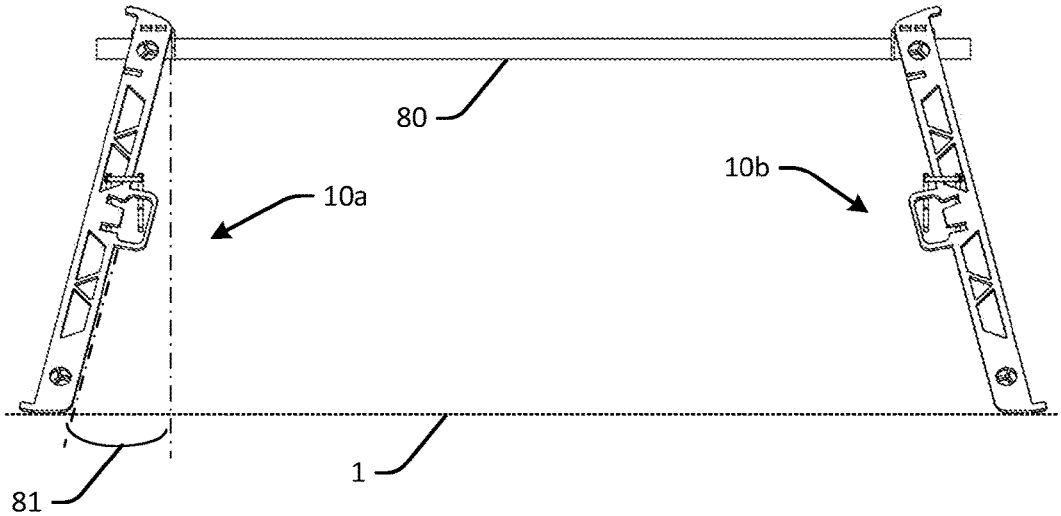
FIG. 18B is a side view of the example modular target structures corresponding to FIG. 18A.

In an example, the modular target structure 10 may be implemented in a vertical orientation by itself, or in combination with another modular target structure 10. FIG. 18A is a perspective view of two modular target structures 10*a*, 10*b* configured to support a beam 80. FIG. 18B is a side view of the example modular target structures 10*a*, 10*b* corresponding to FIG. 18A. Targets may be provided on beam 80.

In an example, the first leg structure 12 and a second leg structure 14 each have at least one angled end portion so that the assembled structure stands at an angle as illustrated by angle 81 in FIG. 18B. This enables the modular target structures 10*a* and 10*b* to be oriented substantially vertically with the angled end portions flat on the ground 1 (e.g., horizontal or parallel to the ground 1).

In addition, the modular target structures 10*a* and 10*b* lean in toward one another, thereby providing additional support. In an example, the angled end portion of the leg structures provides an overall angled position of the support structure 10*a* toward another adjacent support structure 10*b* when the support structure 10*a* and the adjacent support structure 10*b* are positioned in a vertical position facing one another to support a cross beam 80 therebetween.

Figure 19:
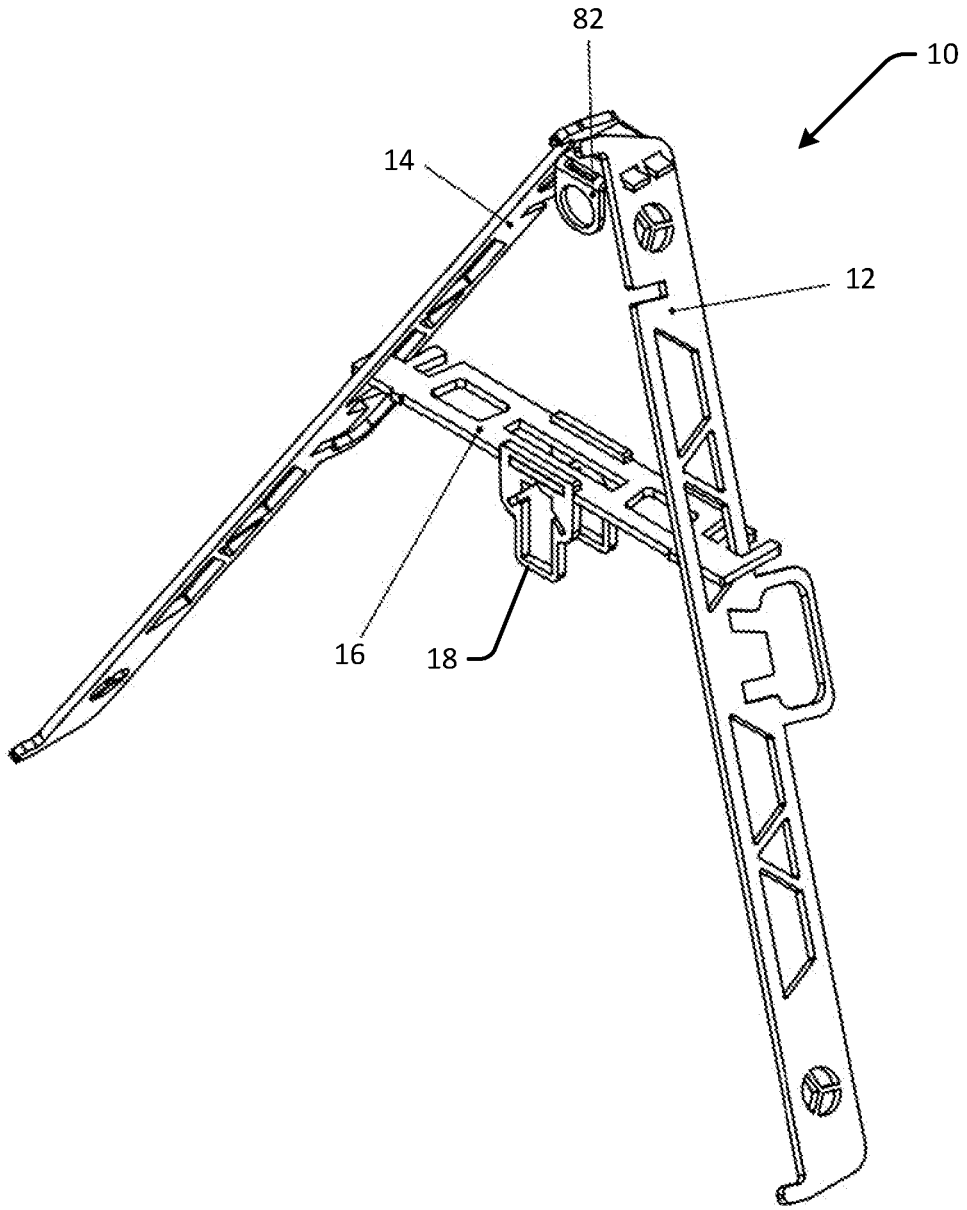
FIG. 19 is a perspective view of the example modular target structure configured with a beam support.
Figure 20:
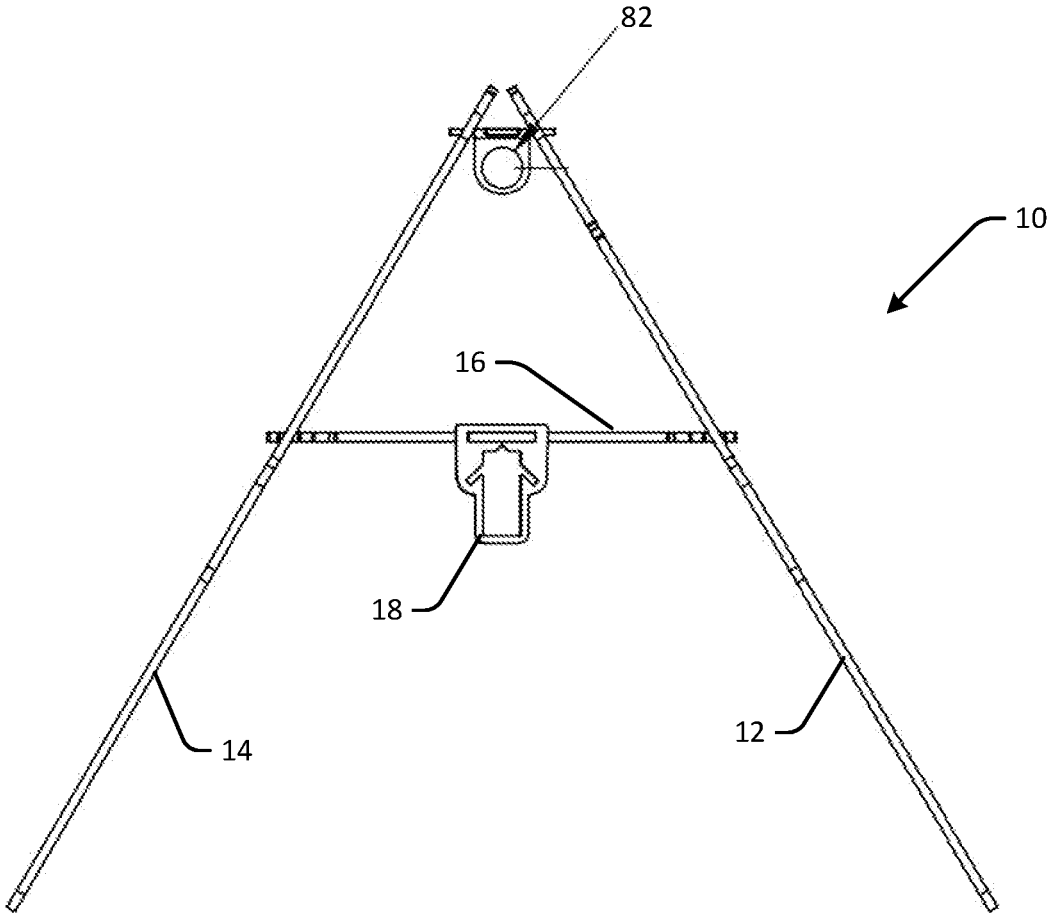
FIG. 20 is a side view of the example modular target structure corresponding to FIG. 19.

FIG. 19 is a perspective view of one of the example modular target structures 10 showing its assembly in detail using a beam support 82. FIG. 20 is a side view of the example modular target structure 10 corresponding to FIG. 19. The beam support 82 may be assembled as part of the modular target structure 10 to retain the first and second leg structures 12 and 14 together.

Figure 21:
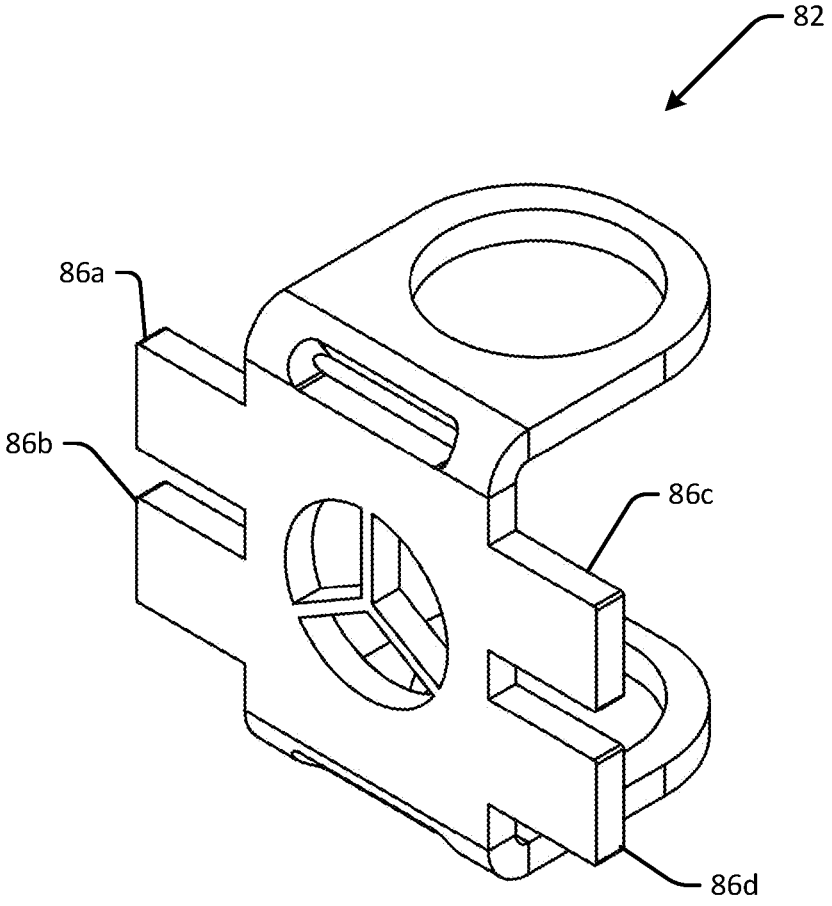
FIG. 21 is a perspective view of an example beam support.
Figure 22A:
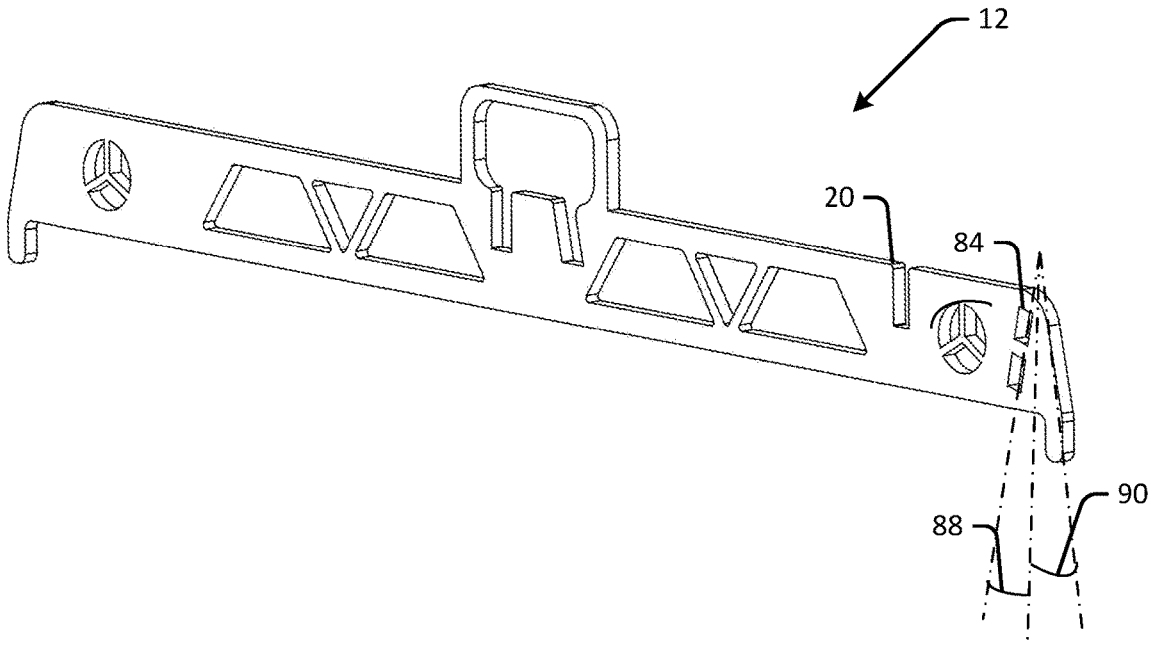
FIG. 22A shows an example of a first leg structure of the modular target structure.
Figure 22B:
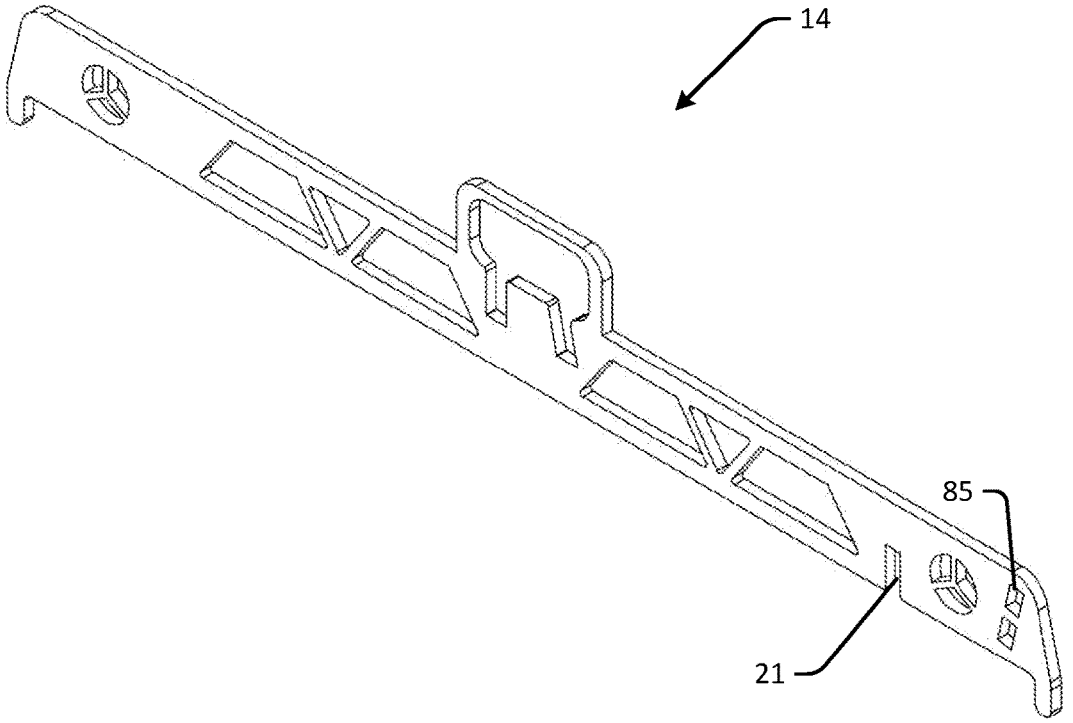
FIG. 22B shows an example of a second leg structure of the modular target structure.

FIG. 21 is a detailed perspective view of an example beam support 82. FIG. 22A shows an example of a first leg structure 12 of the modular target structure 10. FIG. 22B shows an example of a second leg structure 14 of the modular target structure 10. These figures show mounting of the beam support 82.

In an example, one or more openings 84 are formed in a first end of the first leg structure 12, and one or more openings 85 are formed in a first end of the second leg structure 14. The beam support 82 connects via tabs 86*a-d* into the opening(s) 84 and 85 on the first and second leg structures 12 and 14 to connect the first leg structure 12 to the second leg structure 14 (e.g., as illustrated in FIG. 20).

In an example, the opening(s) 84 and 85 each have an offset angle 88 that is equal and opposite to an angle 90 of the angled end portion. The beam support 82 has one or more tabs 86*a-b* on each side to connect into the opening(s) 84 and 85 on the leg structures 12 and 14. When connected, the offset angle 88 of the openings 84 and 85 relative to the tabs 86*a-d* results in the angle 88 relative to the ground 1 so that the leg structures 12 and 14 sit flat on the ground 1 as seen in FIG. 20.

It is noted that the examples shown and described are provided for purposes of illustration and are not intended to be limiting. Still other examples are also contemplated.

The invention claimed is:

1. A modular target structure for supporting targets during target practice, comprising:

a first leg structure;

a second leg structure;

an interconnecting member for connecting between the first leg structure and the second leg structure to form a substantially triangular shaped support structure;

a long edge and an angled end portion on each of the first and second leg structures, the angled end portion offset by more than 90 degrees relative to the long edge to provide a first configuration as a beam supported target;

a beam support;

at least one opening formed in a first end of the first leg structure;

at least one opening formed in a first end of the second leg structure;

wherein the beam support connects into the at least one opening on the first leg structure and the at least one opening on the second leg structure to connect the first leg structure to the in the first configuration;

a post support on the interconnecting member, the post support having an upper portion with a first opening formed therethrough, and a lower portion with a second opening formed therethrough, the post support configured to receive a post through the first and second openings and hold the post in a substantially upright position at an offset angle to provide a second configuration as a post supported target; and at least one target mount;

wherein the support structure is configurable between the first configuration for target practice as the beam supported target and the second configuration for target practice as the post supported target, and a collapsed position for transport and storage.

2. The modular target structure of claim 1, further comprising a first interlocking slot formed on an upper portion of the first end of the first leg structure, and a corresponding second interlocking slot formed on a lower portion of the first end of the second leg structure, wherein the first interlocking slot fits into the second interlocking slot to removably secure the first leg structure to the second leg structure in the second configuration.

3. The modular target structure of claim 1, wherein the angled end portions of the first and second leg structures are configured to stand the support structure on a horizontal surface in an angled position toward another adjacent support structure when the support structure and the adjacent support structure are positioned in a vertical position facing one another to support a cross beam in the first configuration.

4. The modular target structure of claim 1, wherein the beam support has at least one tab on a first side to connect into the at least one opening on the first leg structure, and the beam support has at least one tab on a second side to connect into the at least one opening on the second leg structure.

5. The modular target structure of claim 1, wherein the beam support has at least one opening formed therein to receive a cross beam between adjacent support structures.

6. The modular target structure of claim 1, wherein the post support is offset 170 degrees from a horizontal plane to provide a 10 degree offset for a post provided in the post in the second configuration.

7. The modular target structure of claim 6, further comprising a post for mounting in the post support.

8. The modular target structure of claim 7, further comprising at least one target flag mounted to rotate on the post when the at least one target flag is hit by a firing round.

9. The modular target structure of claim 7, further comprising a silhouette target adapter for mounting on the post, the silhouette target adapter supporting a silhouette target.

10. The modular target structure of claim 9, wherein the silhouette target has a hostage-taker target mounted to rotate on the post when the hostage-taker target is hit by a firing round.

11. The modular target structure of claim 10, wherein the silhouette target has a hostage target hung from a hook on the post.

12. The modular target structure of claim 1, wherein the first leg structure and the second leg structure each have at least one leg formed thereon to raise the support structure above the ground when the support structure is in a horizontal in the second configuration.

13. The modular target structure of claim 1, wherein the first leg structure and the second leg structure each have a leg formed on each end to raise the support structure above the ground when the support structure is in a horizontal in the second configuration.

14. The modular target structure of claim 1, wherein the first leg structure and the second leg structure each have an integrally formed handle.

15. The modular target structure of claim 1, further comprising:

a first target frame mount on the first leg structure, and a second target frame mount on the second leg structure; and a target frame connecting to the first target frame mount and the second target frame mount.

16. A modular target structure for supporting targets during target practice, comprising:

a first leg structure;

a second leg structure;

a long edge and an angled end portion on each of the first and second leg structures, the angled end portion offset by more than 90 degrees relative to the long edge to provide a first configuration as a beam supported target;

an interconnecting member for connecting between the first leg structure and the second leg structure to form a substantially triangular shaped support structure;

a post support on the interconnecting member, the post support configured to receive a post and hold the post in a substantially upright position to provide a second configuration as a post supported target;

a first interlocking slot formed on an upper portion of a first end of the first leg structure, and a corresponding second interlocking slot formed on a lower portion of a first end of the second leg structure, wherein the first interlocking slot fits into the second interlocking slot to removably secure the first leg structure to the second leg structure in the second configuration; and a beam support connecting into at least one opening on the first leg structure and at least one opening on the second leg structure to connect the first leg structure to the second leg structure in the first configuration.

17. The modular target structure of claim 16, further comprising at least one target mount.

18. The modular target structure of claim 16, wherein the support structure is configurable between the first and second configurations for target practice, and a collapsed position for transport and storage.

* * * * *